US010465590B2

(12) United States Patent
Tsubosaka et al.

(10) Patent No.: US 10,465,590 B2
(45) Date of Patent: Nov. 5, 2019

(54) CHANGEOVER VALVE

(71) Applicant: FUTABA INDUSTRIAL CO., LTD., Okazaki-shi, Aichi (JP)

(72) Inventors: Munehiro Tsubosaka, Okazaki (JP); Yusuke Hiramatsu, Okazaki (JP); Yasushi Okamoto, Okazaki (JP); Kazuya Okamoto, Okazaki (JP); Yasufumi Umeno, Okazaki (JP)

(73) Assignee: FUTABA INDUSTRIAL CO., LTD., Okazaki-Shi, Aichi (JP)

( * ) Notice: Subject to any disclaimer, the term of this patent is extended or adjusted under 35 U.S.C. 154(b) by 251 days.

(21) Appl. No.: 15/525,651

(22) PCT Filed: Nov. 10, 2015

(86) PCT No.: PCT/JP2015/081609
§ 371 (c)(1),
(2) Date: May 10, 2017

(87) PCT Pub. No.: WO2016/076312
PCT Pub. Date: May 19, 2016

(65) Prior Publication Data

US 2018/0245501 A1 Aug. 30, 2018

(30) Foreign Application Priority Data

Nov. 10, 2014 (JP) ..... 2014-228230

(51) Int. Cl.
*F01N 1/16* (2006.01)
*F01N 13/10* (2010.01)
*F01N 13/08* (2010.01)

(52) U.S. Cl.
CPC ..... *F01N 13/10* (2013.01); *F01N 1/163* (2013.01); *F01N 1/165* (2013.01); *F01N 1/166* (2013.01);
(Continued)

(58) Field of Classification Search
CPC ..... F01N 1/163; F01N 1/165; F01N 1/166; F01N 2260/14; F01N 2290/10
(Continued)

(56) References Cited

U.S. PATENT DOCUMENTS 5,801,343 A * 9/1998 Suzuki ..... F01N 1/02 181/254
5,984,045 A * 11/1999 Maeda ..... F01N 1/02 181/254
(Continued)

FOREIGN PATENT DOCUMENTS

JP 2005-214024 A 8/2005
JP 2015094316 A * 5/2015 ..... F01N 1/023

OTHER PUBLICATIONS

International Search Report (Form PCT/ISA/210) for International Application No. PCT/JP2015/081609, dated Feb. 9, 2016, 4 pages including English translation.
(Continued)

*Primary Examiner* — Jeremy A Luks
(74) *Attorney, Agent, or Firm* — Withrow & Terranova, P.L.L.C.; Vincent K. Gustafson

(57) ABSTRACT

A changeover valve includes: a valve body portion that closes an opening formed at a switching position of an exhaust flow path; a fixing portion that rotatably fixes the valve body portion; a first raised portion protruding at one of a flow path forming portion and the fixing portion; a cushion portion; a second raised portion protruding at the valve body portion; and a biasing portion that biases the valve body portion. The first raised portion has an inclined portion inclined relative to a valve closing direction and the second raised portion has an inclined portion inclined relative to the valve closing direction. Both of the inclined portions are contactable with each other at the time of valve closing.

9 Claims, 7 Drawing Sheets

(52) U.S. Cl.
CPC ..... *F01N 13/08* (2013.01); *F01N 2260/14* (2013.01); *F01N 2290/10* (2013.01)

(58) Field of Classification Search
USPC ..... 181/253, 254
See application file for complete search history.

(56) References Cited

U.S. PATENT DOCUMENTS

| | | | | |
|---|---|---|---|---|
| 6,581,721 | B2 * | 6/2003 | Nagai | F01N 1/165 137/527.4 |
| 6,637,449 | B2 * | 10/2003 | Nagai | F01N 1/08 137/15.18 |
| 6,736,160 | B2 * | 5/2004 | Nagai | F01N 1/165 137/527 |
| 7,426,979 | B2 * | 9/2008 | Nagai | F01N 1/166 137/527.4 |
| 8,256,570 | B2 * | 9/2012 | Miike | F01N 1/084 181/254 |
| 2014/0166392 | A1 * | 6/2014 | Kye | F01N 13/1894 181/226 |

OTHER PUBLICATIONS

Notification of Transmittal of Copies of Translation of the International Preliminary Report on Patentability (Form PCT/ISA/338) for International Application No. PCT/JP2015/081609, dated May 26, 2017, 1 page.

International Preliminary Report on Patentability (Chapter I of the Patent Cooperation Treaty) (Form PCT/IB/373 and Translation of Form PCT/ISA/237) for International Application No. PCT/JP2015/081609, dated May 16, 2017, 7 pages.

* cited by examiner

Fig.1A
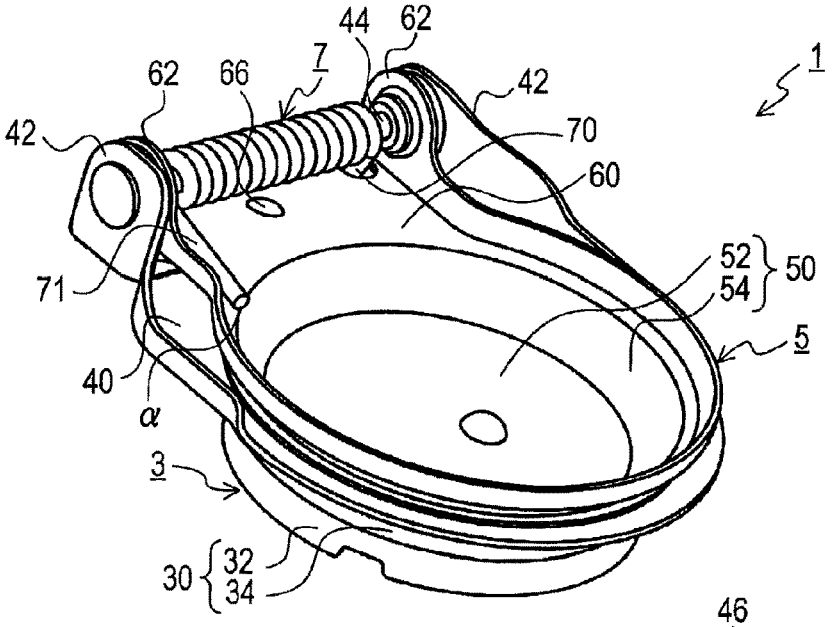
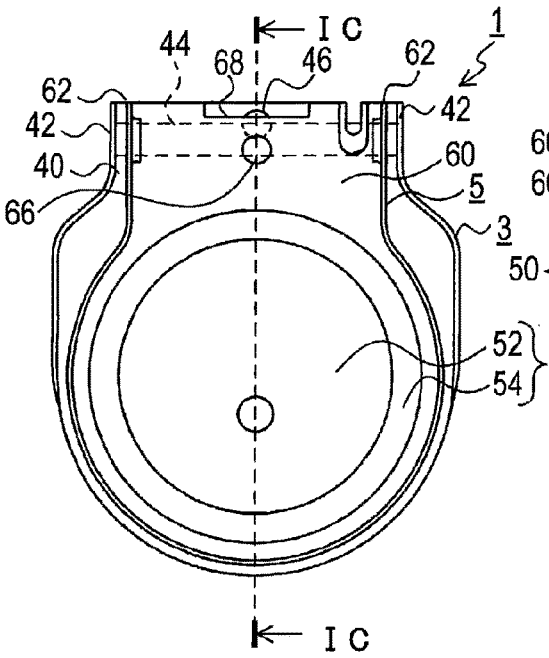
Fig.1B
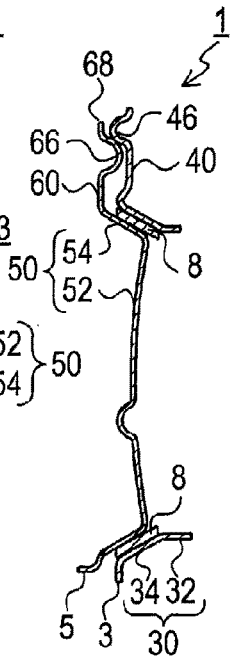
Fig.1C
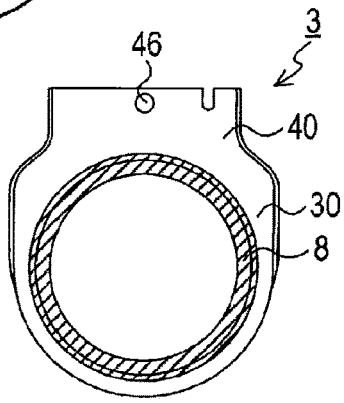
Fig.1D
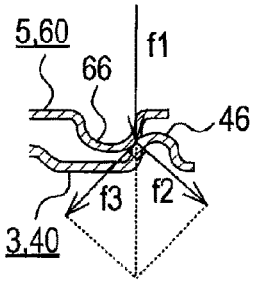
Fig.1E
Fig.1F
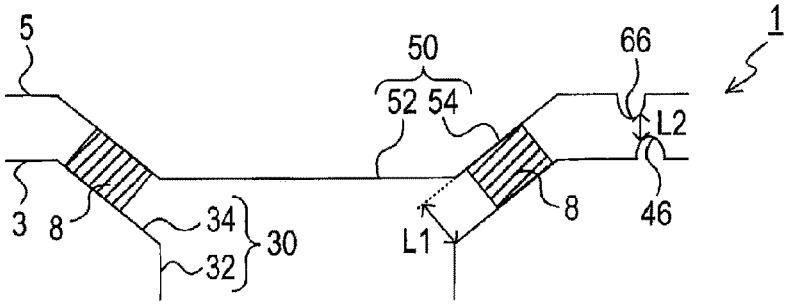

CHANGEOVER VALVE

CROSS-REFERENCE TO RELATED APPLICATIONS

This application is a 35 U.S.C. § 371 national phase filing of International Application No. PCT/JP2015/081609 filed on Nov. 10, 2015, and claims the benefit of Japanese Patent Application No. 2014-228230, filed on Nov. 10, 2014 with the Japan Patent Office. The entire disclosures of International Application No. PCT/JP2015/081609 and Japanese Patent Application No. 2014-228230 are hereby incorporated by reference herein in their respective entireties.

TECHNICAL FIELD

The present disclosure relates to a changeover valve.

BACKGROUND ART

A changeover valve that switches an exhaust flow path by use of a valve body is mounted to an exhaust system of an internal combustion engine. This changeover valve is employed by being attached at an opening portion of an exhaust pipe that opens inside a muffler and so on. In this changeover valve, the valve body capable of closing the opening portion is rotatably supported by a supporting member attached to the exhaust pipe and is biased in a valve closing direction by a coil spring. Therefore, because the pressure of an exhaust gas at an upstream side of the changeover valve is low when the rotational speed of the internal combustion engine is low, the opening portion turns to a valve closed state in which the opening portion is closed by the valve body, and the exhaust sound is reduced. Meanwhile, as the rotational speed of the internal combustion engine goes up, the pressure of the exhaust gas at the upstream side of the changeover valve becomes high. Accordingly, the valve body is separated from the opening portion and the opening portion turns to a valve open state in which the opening portion is released from the valve body, so that pressure loss is reduced.

This changeover valve includes a configuration in which the valve body abuts the supporting member and closes the opening portion of the exhaust pipe. Further, a wire mesh is mounted on the supporting member at an area in which the valve body comes in contact with the supporting member at the time of valve-closing. This wire mesh is held between the valve body and the supporting member at the time of valve-closing and fills in a gap between the valve body and the supporting member. Therefore, exhaust sound leakage through the gap between the valve body and the supporting member is inhibited at the time of valve-closing. Further, the wire mesh functions as a cushion to receive the valve body at the time of valve-closing. Therefore, in a changeover valve having this wire mesh, an occurrence of the hammering sound generated when the valve body contacts the supporting member quickly is inhibited at the time of valve-closing.

Meanwhile, for example, Patent Document 1 discloses a changeover valve not having a wire mesh. This changeover valve has a configuration in which a valve body has a protrusion and the protrusion abuts on a planar surface provided at a supporting member at the time of valve-closing.

PRIOR ART DOCUMENTS

Patent Documents

Patent Document 1: Japanese Unexamined Patent Application Publication No. 2005-214024

SUMMARY OF THE INVENTION

Problems to be Solved by the Invention

In recent years, usage of inferior fuel has been increasing overseas. When inferior fuel (accurately, residue remaining after burning inferior fuel, but hereinafter referred to as inferior fuel for better understanding) adheres to a wire mesh, there is a case that the valve body gets stuck to the wire mesh. In this case, there is a possibility that the valve body does not open even when the rotational speed of the internal combustion engine increases. That is, it is thought that, when inferior fuel is employed, pressure loss becomes remarkably large at a time of high-speed rotation of the internal combustion engine.

Further, a wire mesh becomes thinner and harder over long-term use, and therefore its cushion effect decreases. This results from repeated abutments of the valve body on the wire mesh at the time of valve-closing and pressing the valve body on the wire mesh by the biasing force of the spring. Accordingly, it is thought that a large hammering sound occurs at the time of valve-closing after a long time period of use even if the changeover valve has the wire mesh. If chattering occurs due to exhaust pulsation under this sort of situation, continuous and large hammering sounds are also considered to occur.

Also in the changeover valve described in Patent Document 1, it is considered that the projection impacts the supporting member and a large hammering sound thus occurs at the time of valve-closing.

According to an aspect of the present disclosure, it is desirable to provide a changeover valve that opens and closes even with the usage of inferior fuel and inhibits occurrence of hammering sounds at the time of valve-closing even over long-term use.

Means for Solving the Problems

A changeover valve according to an aspect of the present disclosure switches an exhaust flow path of an internal combustion engine. The changeover valve includes a valve body portion that closes an opening by covering the opening and a periphery of the opening. The opening is formed at a switching position of the exhaust flow path and at one of a flow path forming portion forming the exhaust flow path and a fixing portion fixed to the flow path forming portion. The changeover valve further includes: the fixing portion, that fixes the valve body portion so that the valve body portion rotates between a position to open the opening and a position to close the opening; a first raised portion raised from one of the flow path forming portion and the fixing portion within an opposing area where one of the flow path forming portion and the fixing portion faces the valve body portion at a time of valve closing when the valve body portion closes the opening; a cushion portion arranged at the periphery of the opening at a position including at least the opposing area; a second raised portion raised from the valve body portion and formed at a position where the second raised portion is contactable with the first raised portion at a time of valve closing; and a biasing portion that biases the valve body portion in a valve closing direction in which the valve body portion closes the opening. The first raised portion has an inclined portion inclined relative to the valve closing direction, the second raised portion has an inclined portion inclined relative to the valve closing direction, and the inclined portion of the first raised portion is contactable with the inclined portion of the second raised portion at the time of valve closing.

Because of the above described configuration of the changeover valve, the biasing force of the biasing portion is dispersed among the cushion portion, the first raised portion and the second raised portion if the cushion portion is held between the valve body portion and one of the flow path forming portion and the fixing portion and the first raised portion formed at one of the flow path forming portion and the fixing portion abuts on the second raised portion formed at the valve body portion at the time of valve-closing. Therefore, the valve body portion is inhibited from being pressed strongly onto the cushion portion and the adhesive force of the cushion portion adhered with inferior fuel against the valve body portion lowers. As a result, the valve body portion easily opens from the cushion portion.

Further, because of the above described configuration, by the abutment between the inclined portion of the first raised portion and the inclined portion of the second raised portion, a force applied to the second raised portion at a time of abutment between the first raised portion and the second raised portion is dispersed to a force vertically acting on the inclined portion of the second raised portion and a force acting in a direction vertical thereto (a tangential direction of the inclined portion). As a result, the first raised portion and/or the second raised portion is inhibited from being shaved or depressed. Therefore, the shapes of the first raised portion and the second raised portion are maintained for a long period of time, the cushion portion is less likely to become thin, thereby enabling to inhibit an occurrence of hammering sound at the time of valve-closing even in long-term use.

Accordingly, with this changeover valve, even when inferior fuel is used, it is possible to open and close the valve body portion and to inhibit occurrence of hammering sound at the time of valve-closing even in the long-term use.

Like the changeover valve according to an aspect of the present invention, the valve body portion may be formed in a shape along a side surface of an exhaust pipe defining the flow path forming portion and rotatably fixed to the fixing portion to close the opening formed at the side surface of the exhaust pipe. The cushion portion may be arranged at the periphery of the opening formed at the exhaust pipe. The biasing portion may be fixed to the fixing portion but is not limited thereto.

It is often difficult to secure a space that allows the valve body portion to open and close at an end in a longitudinal direction of the exhaust pipe.

However, according to the above configuration, it opens and closes the opening provided at the side surface of the exhaust pipe, and it thus makes it easier to secure a space to open and close the valve body portion.

Accordingly, with this changeover valve, it is possible to mount the changeover valve on the exhaust pipe even if it is difficult to secure a mounting space.

Like the changeover valve according to an aspect of the present invention, the fixing portion may have a pair of legs arranged away from each other at a certain distance. The pair of legs may have bent portions formed by inwardly bending an end of each of the pair of legs. The fixing portion may be fixed to the flow path forming portion by welding the bent portions on the flow path forming portion. The first raised portion may be formed at each of the bent portions configuring the legs.

When the first raised portion is formed at the exhaust pipe, it may be difficult to determine the position of the fixing portion that fixes the valve body portion formed with the second raised portion, in terms of allowing the abutment between the first raised portion and the second raised portion.

However, with the above configuration of the changeover valve, the first raised portion and the second raised portion have been respectively formed at the fixing portion and the valve body portion having a fixed positional relationship therebetween. Therefore, positional adjustment to make an abutment between the first raised portion and the second raised portion is not needed.

Accordingly, with the above described changeover valve, the changeover valve can be easily mounted on the exhaust pipe without positional adjustment to make the first raised portion abut the second raised portion.

Like the changeover valve according to an aspect of the present invention, when the fixing portion has an insert portion and a valve seat portion both formed in a cylindrical shape, the insert portion may be formed to be coaxially insertable in the exhaust pipe forming the flow path forming portion and may form the opening. The valve seat portion may be formed being radially expanded away from the insert portion. The valve body portion may include a valve seat opposed portion formed at a position where the valve body portion faces the valve seat portion at the time of valve closing and radially contracted in the direction to close the opening. The cushion portion may be arranged at the valve seat portion.

According to this, the changeover valve according to an aspect of the present disclosure has not only the first raised portion but also the cushion portion and all the configuration needed to open and close the opening configuration the changeover valve of an aspect of the present disclosure. Therefore, the changeover valve can be easily mounted on the exhaust pipe such as the flow path forming portion with the insert portion inserted in the exhaust pipe.

The way of contact between the inclined portion of the first raised portion and the inclined portion of the second raised portion may be either a point contact, a line contact, or a surface contact.

Like the changeover valve according to an aspect of the present invention, the first raised portion and the second raised portion may be formed to contact each other at multiple points.

According to this aspect, a force applied therebetween when the first raised portion contacts the second raised portion is dispersed among multiple elements, thereby enabling to inhibit over a long period of time occurrence of hammering sound generated at the time of valve-closing due to long-term use. That is, if the force applied therebetween is dispersed at the time of contact between the first raised portion and the second raised portion, the force becomes less compared with the case where the force applied to each contact point is not dispersed. As a result, the first raised portion and the second raised portion deform with less likelihood, thereby enabling to maintain the shapes of the first raised portion and the second raised portion for a long time span. As described above, if the shapes of the first raised portion and the second raised portion are maintained, it is possible to inhibit over a long period of time the valve body portion from abutting on the flow path forming portion and the fixing portion. Therefore, this changeover valve can inhibit an occurrence of hammering sounds even in long-term use.

Like the changeover valve according to an aspect of the present invention, the first raised portion may be formed in a shape that a projected shape along a surface vertical relative to the direction that the second raised portion is directed towards the first raised portion at the time of valve-closing is in a shape along two sides of a triangle. In this case, the second raised portion may be arranged so as to contact an area corresponding to each side of the first raised portion at the time of valve-closing.

Like the changeover valve according to an aspect of the present invention, the first raised portion and the second raised portion may contact each other at a position that is closer to a position where the valve body portion is rotatably supported relative to the fixing portion than a position where the biasing portion biases the valve body portion.

According to this, compared with the contact between the first raised portion and the second raised portion at a position that is further from the support point than the position where the coil spring 7 biases the valve body portion 5, the moving speed of the valve body portion becomes slower, thereby enabling to make the abutment sound between the first raised portion and the second raised portion smaller.

In addition, when the valve body portion is supported rotatably relative to the fixing portion with the support shaft as a fulcrum, the position where the first raised portion and the second raised portion contact each other may be immediately below the support shaft.

Like the changeover valve according to an aspect of the present invention, the cushion portion may have a thickness so that the first raised portion and the second raised portion face each other at a predetermined distance therebetween when the cushion portion is held between the valve body portion and one of the flow path forming portion and the fixing portion at the time of valve closing.

According to the above described configuration, only the cushion portion receives the biasing force of the biasing portion at the time of valve-closing in the early use stage. In this case, the first raised portion does not contact the second raised portion, and the cushion portion is gradually compressed. Then, by the time when the cushion portion is compressed to be thin enough for the first raised portion to impact the second raised portion, the biasing force is dispersedly received by the cushion portion, the first raised portion, and the second raised portion thereafter.

The changeover valve is configured as described above for the following purposes. In the early use stage, even when inferior fuel gets stuck on the cushion portion, adhesive force that is strong enough for the valve body portion not to be separated is generated with less likelihood. Therefore, during such stage, the biasing force is received only by the cushion portion. Meanwhile, by the time when such adhesive force strong enough for the valve body portion not to be separated is generated, the biasing force is dispersed and received by the cushion portion, the first raised portion, and the second raised portion.

Accordingly, when only the cushion portion receives the biasing force, there is no abutment between the first raised portion and the second raised portion, thereby enabling to inhibit these members from being shaved or depressed. Further, when the biasing force of the biasing portion is dispersed and received by the cushion portion, the first raised portion, and the second raised portion, the valve body portion is not depressed strongly on the cushion portion, and the valve body portion is easily separated even when inferior fuel is stuck on the cushion portion.

As a result, this changeover valve experiences a period of time when there is no contact between the first raised portion and the second raised portion. This delays the possible timing of occurrence of hammering sounds generated due to compressions and so on, thereby enabling to inhibit for a long period of time an occurrence of hammering sounds at the time of valve-closing due to long-term use. Further, when there is a possibility that the valve body portion is not easily separated from the cushion portion, there is a contact between the first raised portion and the second raised portion. Therefore, even when inferior fuel is employed, it is possible to open and close the valve body portion easily.

BRIEF DESCRIPTION OF THE DRAWINGS

FIG. 1A is a perspective view of a changeover valve of a first embodiment;

FIG. 1B is a plan view of the changeover valve of the first embodiment, in which a coil spring is not illustrated;

FIG. 1C is a cross-sectional view taken along line IC-IC of FIG. 1B;

FIG. 1D is a plan view of a fixing portion;

FIG. 1E is a partially enlarged view of FIG. 2C;

FIG. 1F is a pattern diagram schematically illustrating a thickness of a cushion portion and a distance between a first raised portion and a second raised portion, regarding the changeover valve of the first embodiment;

EXPLANATION OF REFERENCE NUMERALS

Figure 2A:
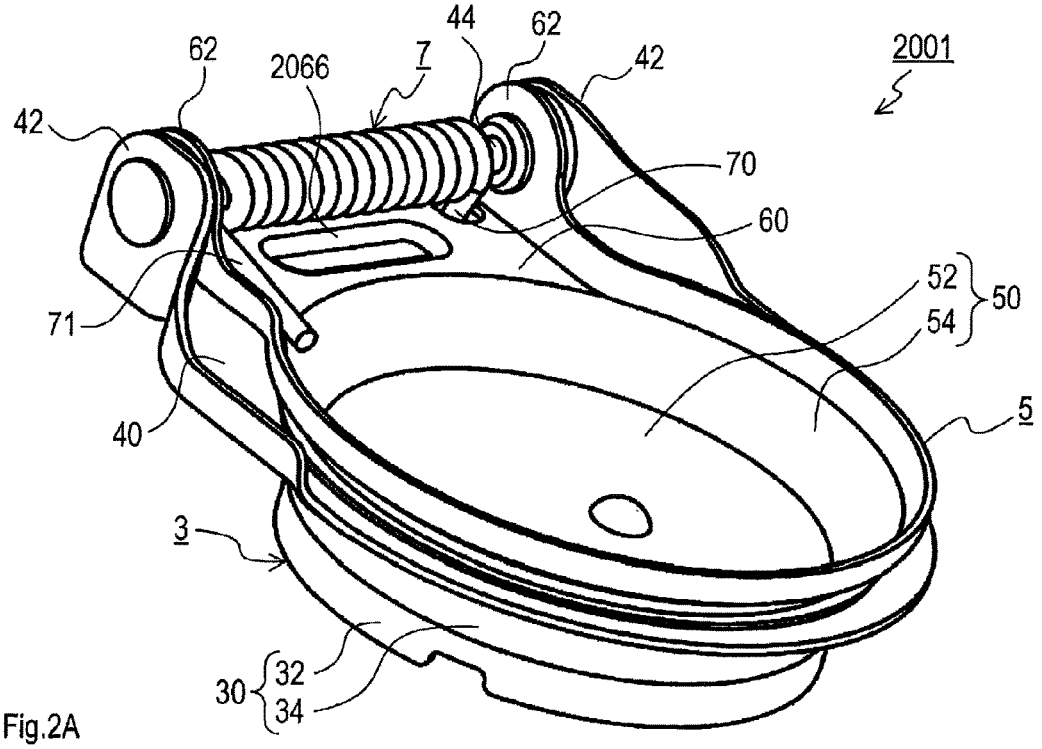
FIG. 2A is a perspective view of a changeover valve of a second embodiment.

1 . . . changeover valve, 3 . . . fixing portion, 5 . . . valve body portion, 7 . . . coil spring, 8 . . . cushion portion, 9 . . . exhaust pipe, 30 . . . exhaust pipe attachment portion, 32 . . . insert portion, 34 . . . valve seat portion, 40 . . . flange, 42 . . . first bent portion, 44 . . . support shaft, 46 . . . first raised portion, 50 . . . valve main portion, 52 . . . bottom surface portion, 54 . . . valve seat opposed portion, 60 . . . flange, 62 . . . second bent portions, 66 . . . second raised portion, 68 . . . notch, 70 . . . extension, 71 . . . extension, 90 . . . opening, 2001 . . . changeover valve, 2046 . . . first raised portion, 2066 . . . second raised portion, 3001 . . . changeover valve, 3046 . . . first raised portion, 4001 . . . changeover valve, 4046 . . . first raised portion, 5001 . . . changeover valve, 5046 . . . first raised portion, 5066 . . . second raised portion, 6001 . . . changeover valve, 6003 . . . fixing portion, 6005 . . . valve body portion, 6008 . . . cushion portion, 6036 . . . leg, 6037 . . . bridge, 6038 . . . bent portion, 6044 . . . support shaft, 6046 . . . first raised portion, 6047 . . . inclined surface, 6050 . . . valve main portion, 6060 . . . flange, 6062 . . . second bent portions, 6066 . . . second raised portion, 6067 . . . inclined surface, 6069 . . . hole, 7001 . . . changeover valve, 7005 . . . valve body portion, 7046 . . . first raised portion, 7050 . . . valve main portion, 7060 . . . flange, 7066 . . . second raised portion, 8001 . . . changeover valve, 8003 . . . fixing portion, 8005 . . . valve body portion, 8036 . . . leg, 8038 . . . bent portion, 8046 . . . first raised portion, 8050 . . . valve main portion, 8060 . . . flange, 8062 . . . second bent portions, 8066 . . . second raised portion

MODE FOR CARRYING OUT THE INVENTION

[Embodiment 1]

Described below is a first embodiment of the present disclosure as an example with reference to the drawings.

As illustrated in FIG. 1A, a changeover valve 1 of the first embodiment is mainly provided with a fixing portion 3, a valve body portion 5, a coil spring 7, and a cushion portion 8 (see FIG. 1C).

The fixing portion 3 is a member attached to an opening at a downstream side of an exhaust pipe that is open inside a muffler and so on and includes an exhaust pipe attachment portion 30 and a flange 40. The exhaust pipe attachment portion 30 is formed entirely in a cylindrical shape so that a cross-section cut perpendicularly to its center axis is circular.

This exhaust pipe attachment portion 30 has two parts arranged along the center axis; one is an insert portion 32 and the other one is a valve seat portion 34. The insert portion 32 is formed in a cylindrical shape being large enough to be fitted into the exhaust pipe.

The valve seat portion 34 is provided at a non-insert side of this insert portion 32 (hereinafter, for the same direction, the direction in which the valve seat portion 34 is located seen from the insert portion 32 is referred to as a non-insert side) and is formed in a truncated cone shape with a diameter expanding away from the insert portion 32.

The changeover valve 1 is configured to switch an exhaust flow path. The exhaust pipe to which the insert portion 32 is attached forms this exhaust flow path. When the insert portion 32 is attached to the exhaust pipe, an opening at the side of the valve seat portion 34 of the insert portion 32 (an opening positioned at a boundary between the insert portion 32 and the valve seat portion 34) becomes an opening formed at a switching position of the exhaust flow path.

The flange 40 is formed in a flat plate shape along an opening at the non-insert side of the valve seat portion 34 and extends from an edge of this opening outwardly in a radial direction of this opening. Both ends along the extending direction of the flange 40 are bent vertically towards the non-insert side.

Hereinafter, these vertically bent portions of the flange 40 are referred to as first bent portions 42. A support shaft 44 is fixed over the first bent portions 42 perpendicularly to the extending direction of the flange 40.

As illustrated in FIGS. 1B and 1C, the flange 40 includes a first raised portion 46 protruding towards the side of a flange 60 described later. This first raised portion 46 is provided at the center in the width direction of the flange 40 (direction in which the first bent portions 42 face each other) and at the vicinity immediately below the arrangement of the support shaft 44.

As illustrated in FIG. 1C, the first raised portion 46 is in a conical shape with its rounded top. At the time of valve-closing, the first raised portion 46 abuts on a second raised portion 66 (described later) at a first inclined portion provided on a peripheral side surface about the center axis of the conical shape and slanted relative to the direction in which these protrude.

As illustrated in FIG. 1A, the valve body portion 5 is a member attached to be rotatable relative to the fixing portion 3 and includes a valve main portion 50 and the flange 60. The valve main portion 50 includes a disc-shaped bottom surface portion 52 and a valve seat opposed portion 54 standing up from an edge of this bottom surface portion 52.

The valve seat opposed portion 54 is shaped in a truncated cone shape radially expanding away from the bottom surface portion 52. The valve seat opposed portion 54 expands in the diameter direction at the same ratio as the valve seat portion 34 of the exhaust pipe attachment portion 30. In other words, since the valve body portion 5 functions to close the opening formed by the insert portion 32 of the fixing portion 3, it is said that the valve seat opposed portion 54 is contracted radially in the direction to close the opening.

The valve seat opposed portion 54 is formed to be large enough to be fitted in the valve seat portion 34. Therefore, the valve main portion 50 closes the exhaust flow path by attaching the fixing portion 3 at the exhaust pipe with the valve seat opposed portion 54 fitted in the valve seat portion 34. That is, when the valve seat opposed portion 54 is fitted in the valve seat portion 34, the valve main portion 50 closes, that is, closes the opening formed by the insert portion 32 and formed at the switching position of the exhaust flow path.

The flange 60 is formed in a flat plate shape along an opening at the non-insert side of the valve seat opposed portion 54 and extends from the edge of this opening outwardly in a diameter direction of this opening. Both ends along the extending direction of the flange 60 are bent vertically towards the non-insert side. Hereinafter, the vertically bent ends are referred to as second bent portions 62. Provided at the second bent portions 62 are holes through which the support shaft 44 passes. With the support shaft 44 inserted in the holes, the valve body portion 5 is attached to be rotatable relative to the fixing portion 3.

The flange 60 is provided with a notch 68 at its one end, that is positioned in its extending direction and at the opposite side of the side provided with the valve main portion 50, and at the middle in the width direction of the flange 60 (the direction in which the second bent portions 62 face each other). The notch 68 is formed a long the width direction. This notch 68 functions to inhibit the flange 60 from abutting the first raised portion 46 and stopping (to inhibit opening limitation due to the contact with the first raised portion 46) when the valve body portion 5 rotates relative to the fixing portion 3 and opens.

As illustrated in FIGS. 1B and 1C, this flange 60 includes the second raised portion 66 protruding towards the flange 40. This second raised portion 66 is provided at the middle in the width direction of the flange 60 and in the vicinity immediately below the arrangement of the support shaft 44. However, the second raised portion 66 is located at the side closer to the valve main portion 50 than the first raised portion 46 is.

As illustrated in FIG. 1C, the second raised portion 66 is in a conical shape with a rounded top. At the time of valve-closing, the second raised portion 66 abuts on the first raised portion 46 at an inclined portion provided on a peripheral side surface about the center axis of the conical shape and slanted relative to the direction in which these protrude. The first raised portion 46 and the second raised portion 66 point-contact each other in the vicinity immediately below the support shaft 44.

As illustrated in FIG. 1A, the coil spring 7 is wound around the support shaft 44 between the second bent portions 62. Provided at both ends of the coil spring 7 are extensions 70 and 71 extending in a tangential direction of the winding direction of the coil spring 7. The extension 70 of this coil spring 7 is fixed, at its end, to the fixing portion 3 and the extension 71 abuts, at its end, on the flange 60 in the vicinity of the edge of the opening at the non-insert side of the valve seat opposed portion 54. With the coil spring 7 arranged as described above, the valve body portion 5 is biased towards the fixing portion 3.

As illustrated in FIGS. 1C and 1D, the cushion portion 8 is adhered at an inside surface of the valve seat portion 34 configuring the fixing portion 3, that is, at an area where the valve body portion 5 abuts, and is configured with a wire mesh.

As illustrated in FIG. 1F, this cushion portion 8 has a thickness (L1) so that the first raised portion 46 and the second raised portion 66 face each other at a predetermined distance (L2) therebetween when the cushion portion 8 is held between the valve body portion 5 and the fixing portion 3 at the time of valve-closing during its non-use.

The cushion portion 8 at the time of valve-closing and the distance L2 of the point-contact between the first raised portion 46 and the second raised portion 66 at the time of valve-closing have a relationship of L1>L2.

Described below is the operation of the changeover valve 1 configured as described above.

When the rotational speed of the internal combustion engine is low, the pressure of exhaust gas at the upstream side of the changeover valve 1 is low. Therefore, the valve body portion 5 is biased by the coil spring 7 and the valve body portion 5 abuts on the fixing portion 3. The changeover valve 1 thus closes by closing the internal space of the fixing portion 3. On the other hand, when the rotational speed of the internal combustion engine rises, the pressure of exhaust gas at the upstream side of the changeover valve 1 increases. Therefore, the exhaust gas pushes the valve body portion 5 against the biasing force of the coil spring 7, and the changeover valve 1 opens the valve.

Further, with the thickness of the cushion portion 8 as described above, in the early use stage of the changeover valve 1, the first raised portion 46 and the second raised portion 66 does not contact each other. Therefore, the changeover valve 1 closes with the valve body portion 5 abutted on the fixing portion 3 via the cushion portion 8.

However, when the cushion portion 8 is compressed over long-time usage, the changeover valve 1 closes with the contact between the first raised portion 46 and the second raised portion 66 in addition to the abutment between the valve body portion 5 and the fixing portion 3 via the cushion portion 8.

Described below are effects characterized in the changeover valve 1 that is configured and functions as described above.

The cushion portion 8 has a thickness such that the first raised portion 46 faces the second raised portion 66 at the predetermined distance therebetween when the cushion portion 8 is held between the valve body portion 5 and the fixing portion 3 at the time of valve-closing. Accordingly, even with usage of inferior fuel, valve opening and closing are performed. Further, it is possible to efficiently inhibit occurrence of hammering sounds generated at the time of valve-closing due to long-term use.

This is because, even when inferior fuel adheres, the cushion portion 8 hardly has, in the early use stage, adhesive force that does not allow the valve body portion 5 to be separated. Further, this is because, by the time when the cushion portion 8 has such adhesive force that does not allow the valve body portion 5 to be separated, the cushion portion 8 is compressed and the first raised portion 46 abuts on the second raised portion 66.

In the early use stage, there is no contact between the first raised portion 46 and the second raised portion 66. As a result, while there is no contact therebetween, there is no worry of occurrence of their deformations. That is, in the changeover valve 1, because it is possible to delay the possible timing of compressions of these members, it is possible to inhibit over a long period of time occurrence of hammering sounds generated by the direct contact between the valve body portion 5 and the fixing portion 3 at the time of valve-closing.

Further, when the first raised portion 46 abuts on the second raised portion 66, the valve body portion 5 is inhibited from being strongly pressed on the cushion portion 8 at the time of valve-closing. Accordingly, even with usage of inferior fuel, the valve body portion 5 is opened and closed easily and it is possible to inhibit occurrence of hammering sound generated at the time of valve-closing due to long-term use.

This is because, for the changeover valve having the first raised portion 46 and the second raised portion 66, the biasing force applied to the valve body portion 5 by the coil spring 7 at the time of valve-closing is dispersed to the cushion portion 8, the first raised portion 46, and the second raised portion 66. That is, regarding the changeover valve 1, even when inferior fuel has been adhered to the cushion portion 8, the changeover valve 1 makes the force to press the valve body portion 5 onto the cushion portion 8 less than a changeover valve not having the first raised portion 46 or the second raised portion 66. Therefore, the valve body portion 5 becomes easy to separate from the cushion portion 8, and the cushion portion 8 is unlikely to be compressed by the valve body portion 5.

Accordingly, the changeover valve 1 opens and closes easily even when inferior fuel is employed and inhibits an occurrence of hammering sound that is generated at the time of valve closing due to the compression of the cushion portion 8 in long-term use.

Further, as illustrated in FIG. 1E, following the abutment between the inclined portion of the first raised portion 46 and the inclined portion of the second raised portion 66, a force (f1) applied to the second raised portion 66 generated at the time of abutment of the first raised portion 46 on the second raised portion 66 is dispersed to a force (f2) perpendicularly acting on the abutment between the first raised portion 46 and the second raised portion 66 and a force (f3) directed perpendicular to the force (f2). Therefore, it is possible to inhibit an occurrence of hammering sounds generated at the time of valve-closing due to long-term use.

This is because, with the second raised portion 66 having the inclined portion inclined relative to the direction towards the first raised portion 46, when the first raised portion 46 contacts the second raised portion 66 at the time of valve-closing, the force (f1) of abutment of the first raised portion 46 on the second raised portion 66 is dispersed because, for example, an element (f3) of the force (f1) is directed in the tangential direction of the inclined portion. The dispersed force is assumed to be absorbed by the coil spring 7 and so on.

As described above, according to the dispersion of the abutment force, the force applied to the first raised portion 46 and the second raised portion 66 (f2) becomes smaller than the abutment force (f1) of the first raised portion 46 on the second raised portion 66. As a result, the first raised portion 46 and the second raised portion 66 hardly deforms, at least compared with the conventional case in which the protrusion abuts on the flat surface, and the shapes are able to be maintained for a long time span. Therefore, the cushion portion 8 does not become thin, and it is thus possible to inhibit the direct impact of the valve body portion 5 on the fixing portion 3 at the time of valve-closing for a long time span. Accordingly, the changeover valve 1 allows the hammering sound to barely occur at the time of valve-closing even in long time use.

Further, with the changeover valve 1, the first raised portion 46 contacts the second raised portion 66 at the position that is closer to the side of the support shaft 44 (immediately below the support shaft 44) rather than to the position a where the coil spring 7 biases the valve body portion 5 (the position where the extension 71 contacts the fixing portion 3, see FIG. 1A). Therefore, compared with the contact between the first raised portion 46 and the second raised portion 66 at the position that is further from the support point than the position where the coil spring 7 biases the valve body portion 5, the moving speed of the valve body portion 5 when contacting becomes slower, thereby enabling to make the contact sound smaller.

[Embodiment 2]

Described below is a second embodiment of the present disclosure as an example with reference to the drawings. However, only differences of the second embodiment from the first embodiment are described below.

Figure 2B:
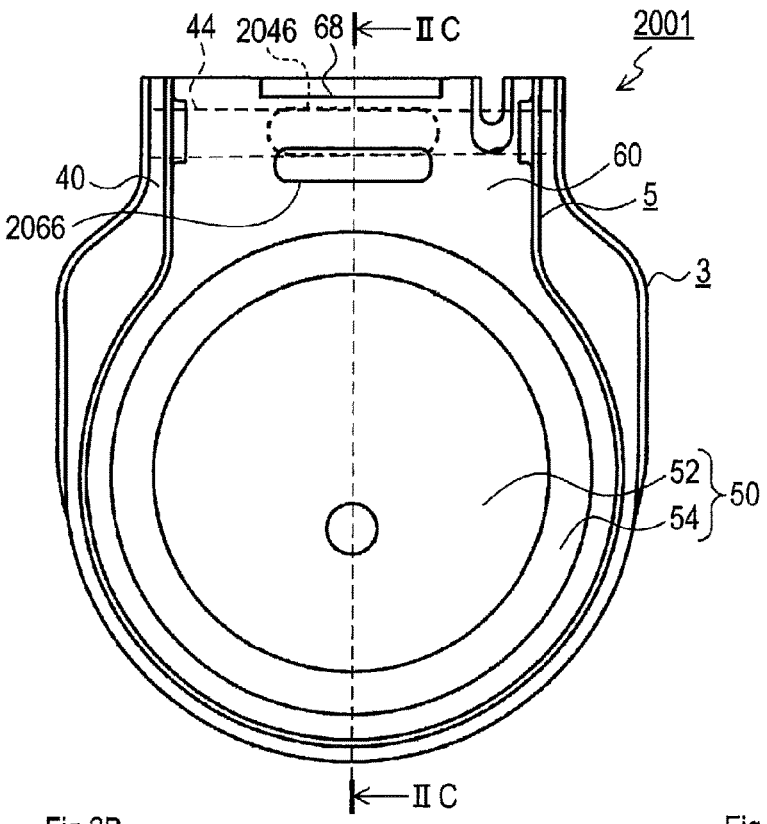
FIG. 2B is a plan view of the changeover valve of the second embodiment, in which a coil spring is not illustrated.
Figure 2C:
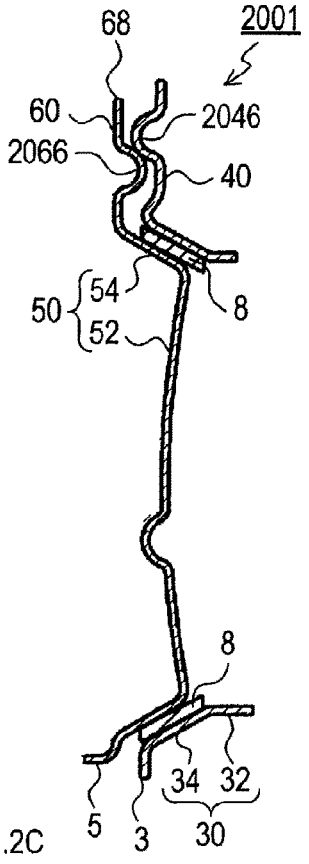
FIG. 2C is a cross-sectional view taken along line IIC-IIC of FIG. 2B.

A changeover valve 2001 of the second embodiment illustrated in FIGS. 2A to 2C has a first raised portion 2046 and a second raised portion 2066 as a configuration different from the one of the changeover valve 1 of the first embodiment.

The first raised portion 2046 and the second raised portion 2066 are different from the conical shape of the first embodiment in that each is a protrusion having a long-length shape along the support shaft 44.

The first raised portion 2046 and the second raised portion 2066 of the changeover valve 2001 are brought into line contact at the time of valve-closing. When the line contact is made between the first raised portion 2046 and the second raised portion 2066, the force applied to these at the time of abutment is dispersed. As described above, by the dispersion of the force applied therebetween when the first raised portion 2046 contacts the second raised portion 2066, the first raised portion 2046 and the second raised portion 2066 are deformed with less likelihood, thereby enabling to easily maintain the shapes of the first raised portion 2046 and the second raised portion 2066 for a long period of time.

As described above, as a result of the long-term maintaining of the shapes of the first raised portion 2046 and the second raised portion 2066, it is possible to inhibit the abutment of the valve body portion 5 on the fixing portion 3 over a long term. Therefore, this configuration of the changeover valve 2001 of the second embodiment can inhibit over a longer period of time an occurrence of the hammering sound due to the direct abutment between the valve body portion 5 and the fixing portion 3 at the time of valve closing, in addition to realizing the effects yielded by the changeover valve 1 of the first embodiment.

[Embodiment 3]

Described below is a third embodiment of the present disclosure as an example with reference to the drawings. However, only differences of the third embodiment from the first embodiment are described below.

Figure 3A:
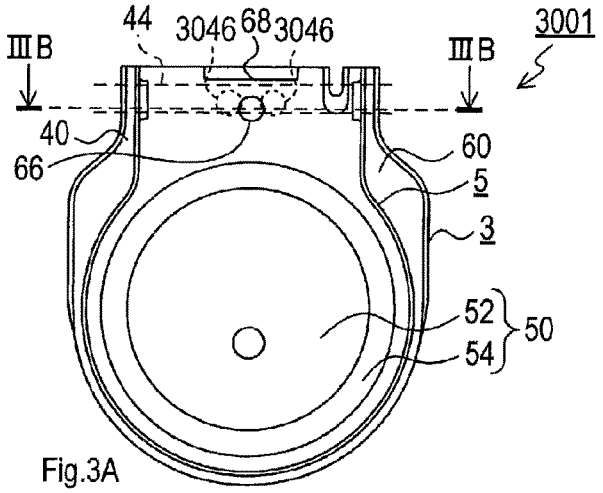
FIG. 3A is a plan view of a changeover valve of a third embodiment, in which a coil spring is not illustrated.
Figure 3B:
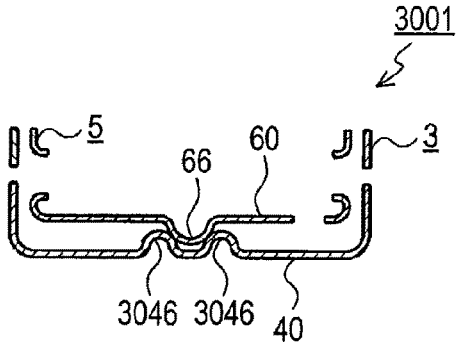
FIG. 3B is a cross-sectional view taken along line IIIB-IIIB of FIG. 3A.

A changeover valve 3001 of the third embodiment illustrated in FIGS. 3A and 3B has a first raised portion 3046 as a configuration different from the one of the changeover valve 1 of the first embodiment.

The first raised portion 3046 is different from the one of the first embodiment in that the first raised portion 3046 has two protrusions arranged along the support shaft 44.

The second raised portion 66 of the changeover valve 3001 contacts both of the first raised portion 3046 at the time of valve-closing. As described above, as a result of the contact of the first raised portion 3046 and the second raised portion 66 at the two points, the force applied to these at the time of abutment is dispersed.

Therefore, the changeover valve 3001 can inhibit over a longer period of time an occurrence of the hammering sound at the time of valve-closing due to the direct abutment between the valve body portion 5 and the fixing portion 3, in addition to realizing the effects yielded by the changeover valve 1 of the first embodiment.

[Embodiment 4]

Described below is a fourth embodiment of the present disclosure as an example with reference to the drawings.

However, only differences of the fourth embodiment from the third embodiment are described below.

Figure 3C:
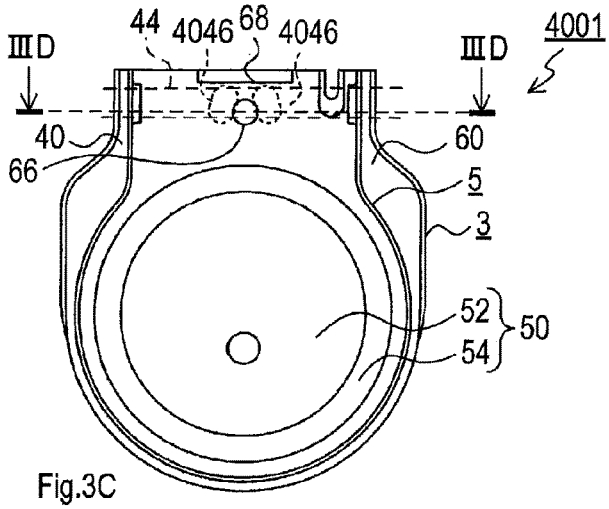
FIG. 3C is a plan view of a changeover valve of a fourth embodiment, in which a coil spring is not illustrated.
Figure 3D:
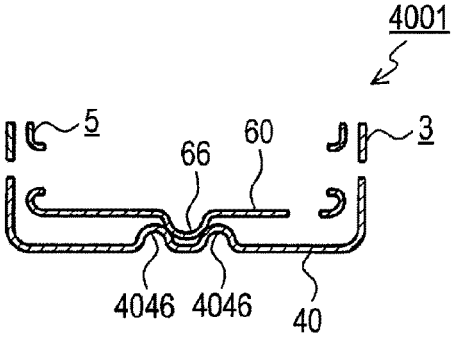
FIG. 3D is a cross-sectional view taken along line IIID-IIID of FIG. 3C.

A changeover valve 4001 of the fourth embodiment illustrated in FIGS. 3C and 3D has a first raised portion 4046 as a configuration different from the changeover valve 3001 of the third embodiment.

The first raised portion 4046 is different from the one of the third embodiment in that the first raised portion 4046 has two protrusions arranged in an inverse V shape (the shape of the alphabet V up-side down, the same shall apply hereinafter).

The second raised portion 66 of the changeover valve 4001 contacts both of the first raised portion 4046 at the time of valve-closing. As described above, as a result of the contact of the first raised portion 4046 and the second raised portion 66 at the two points, the force applied to these at the time of abutment is dispersed. Therefore, the changeover valve 4001 can inhibit over a longer period of time an occurrence of the hammering sound due to the direct abutment between the valve body portion 5 and the fixing portion 3 at the time of valve-closing, in addition to realizing the effects yielded by the changeover valve 1 of the first embodiment.

Further, in the changeover valve 4001, because of the arrangement of the first raised portion 4046 in the inverse V shape, the second raised portion 66 abuts on either one of the protrusions of the first raised portion 4046 even when the valve body portion 5 is displaced in an extending or width direction of the flange 40. Therefore, even when the displacement between the fixing portion 3 and the valve body portion 5 is present, the changeover valve 4001 can inhibit an occurrence of the hammering sound due to the direct abutment between the valve bod portion 5 and the fixing portion 3 at the time of valve-closing.

[Embodiment 5]

Described below is a fifth embodiment of the present disclosure as an example with reference to the drawings. However, only differences of the fifth embodiment from the first embodiment are described below.

Figure 3E:
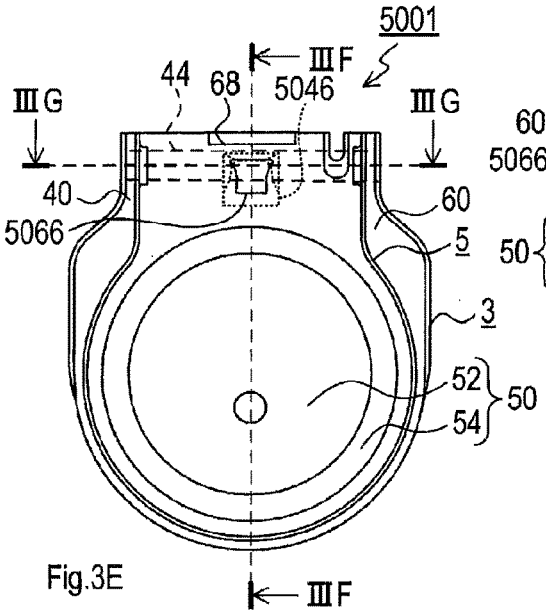
FIG. 3E is a plan view of a changeover valve of a fifth embodiment, in which a coil spring is not illustrated.
Figure 3F:
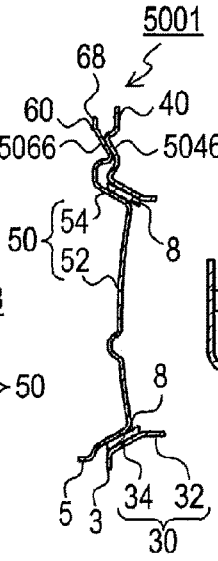
FIG. 3F is a cross-sectional view taken along line IIIF-IIIF of FIG. 3E.
Figure 3G:
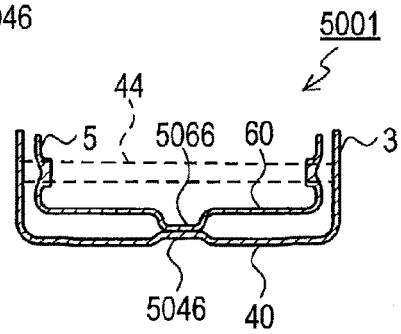
FIG. 3G is a cross-sectional view taken along line IIIG-IIIG of FIG. 3E.

A changeover valve 5001 of the fifth embodiment illustrated in FIGS. 3E to 3G has a first raised portion 5046 and a second raised portion 5066 as a configuration different from the one of the changeover valve 1 of the first embodiment.

The first raised portion 5046 is provided on the flange 40 and protrudes towards the flange 60 with a right-angled triangle cross section. The second raised portion 5066 is provided on the flange 60 and protrudes towards the flange 40 with a right-angled triangle cross section. In addition, the first raised portion 5046 and the second raised portion 5066 are respectively formed in a way that the inclined surface of the triangle of the first raised portion 5046 makes a surface contact with the inclined surface of the triangle of the second raised portion 5066 when the first raised portion 5046 abuts on the second raised portion 5066.

As described above, as a result of the contact between the first raised portion 5046 and the second raised portion 5066, the force applied to these members is dispersed more than a point contact or a line contact.

Therefore, the changeover valve 5001 can inhibit over a longer period of time an occurrence of the hammering sound due to the direct abutment between the valve body portion 5 and the fixing portion 3 at the time of valve-closing, in addition to realizing the effects yielded by the changeover valve 1 of the first embodiment.

[Embodiment 6]

Described below is a sixth embodiment of the present disclosure as an example with reference to the drawings. However, only differences of the sixth embodiment from the first embodiment are described below.

Figure 4A:
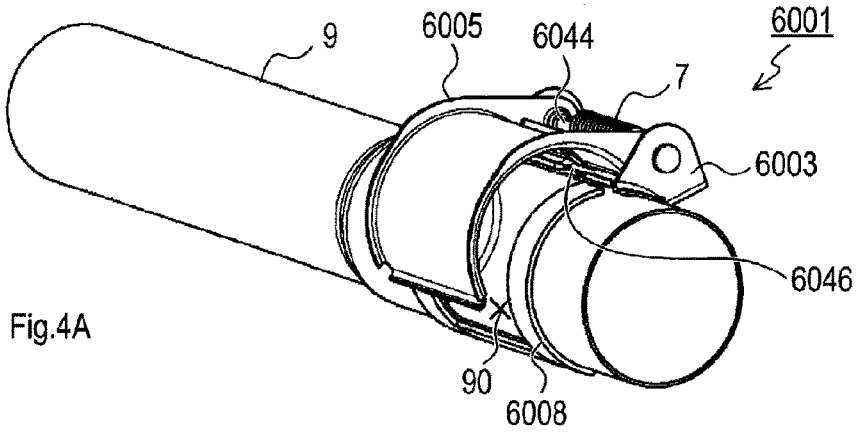
FIG. 4A is a perspective view of an exhaust pipe mounted with a changeover valve of a sixth embodiment.

As illustrated in FIG. 4A, regarding a changeover valve 6001 of the sixth embodiment, the opening 90 is formed at the exhaust pipe 9 defining the exhaust flow path of the internal combustion engine, and the opening 90 is opened and closed. The changeover valve 6001 is different from the changeover valve 1 of the first embodiment mainly in that a fixing portion 6003 does not have the exhaust pipe attachment portion 30 or the flange 40 (see FIG. 1A) as the changeover valve 1 of the first embodiment does.

The changeover valve 6001 has a valve body portion 6005 to close the opening 90.

Figure 4B:
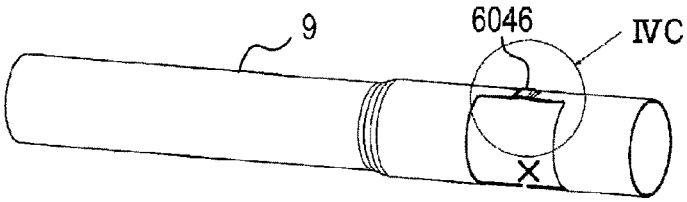
FIG. 4B is a perspective view of an exhaust pipe having a first raised portion, to which the changeover valve of the sixth embodiment is mounted first raised portion.
Figure 4C:
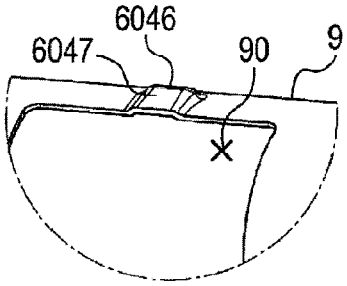
FIG. 4C is an enlarged view of a portion illustrated with a sign IVC in FIG. 4B.

As illustrated in FIGS. 4B and 4C, the changeover valve 6001 has a first raised portion 6046 rising from the exhaust pipe 9. When the exhaust pipe 9 is viewed from the front, the opening 90 is formed in a square shape having two sides along the arc of the exhaust pipe 9 and another two sides along the axial direction of the exhaust pipe 9. The first raised portion 6046 is provided in the vicinity of the center of the side along the axial direction of the exhaust pipe 9 out of the four sides.

As illustrated in FIG. 4C, the first raised portion 6046 forms an inclined surface 6047 slanting down towards the opening 90.

Figure 5A:
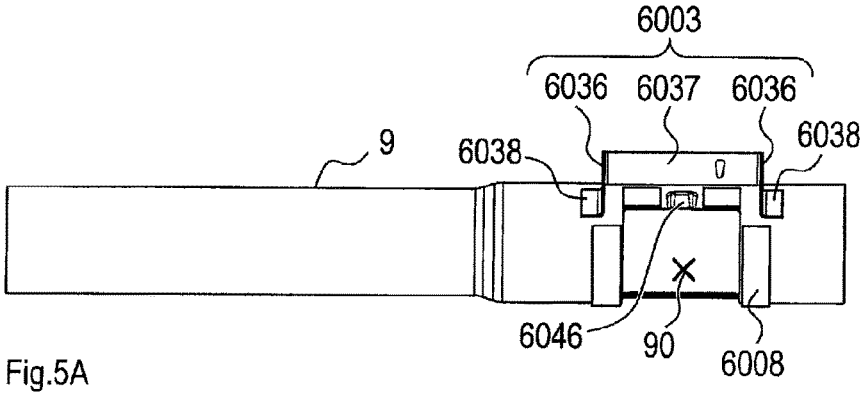
FIG. 5A is a front view of the exhaust pipe, with the valve body portion detached from a fixing portion.
Figure 5B:
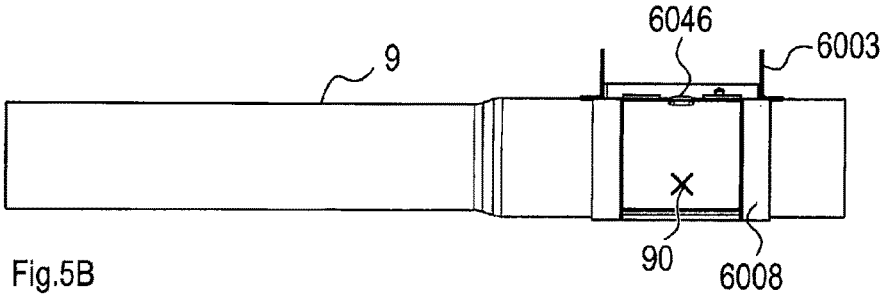
FIG. 5B is a front view of the exhaust pipe as well as FIG. 5A, with the exhaust pipe rotated in a way that the first raised portion is positioned above.

As illustrated in FIGS. 5A and 5B, the changeover valve 6001 has a cushion portion 6008 arranged at the periphery of the opening 90. The cushion portion 6008 is adhered at an outer surface of the exhaust pipe 9 and at an area where the valve body portion 6005 faces the exhaust pipe 9 when the valve body portion 6005 closes the opening 90.

Figure 5C:
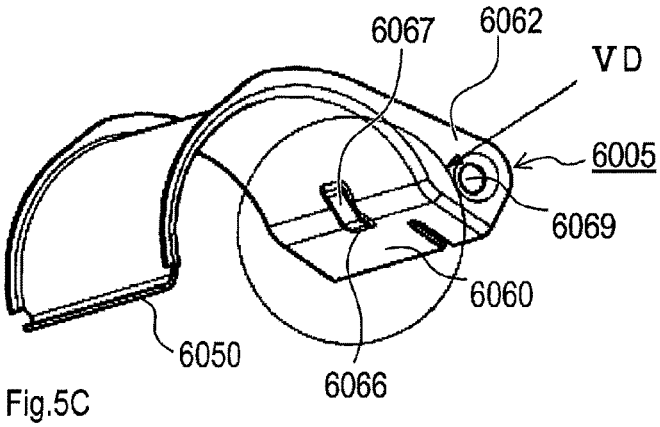
FIG. 5C is a perspective view of the valve body portion.
Figure 5D:
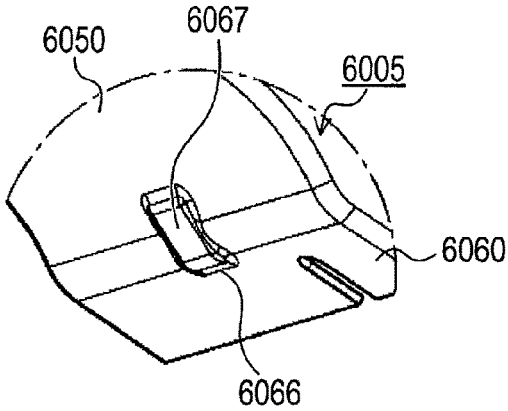
FIG. 5D is an enlarged view of a portion illustrated with a sign VD in FIG. 5C.

As illustrated in FIGS. 5C and 5D, in order to close the opening 90 formed at the side surface of the exhaust pipe 9, the valve body portion 6005 has a valve main portion 6050 formed in an arc shape along the side surface of the exhaust pipe 9. The valve body portion 6005 further has a flange 6060 at one side out of both sides positioned at both ends in the direction along the arc shaped by the valve main portion 6050. The coil spring 7 is fixed to the flange 6060.

Regarding the valve body portion 6005, a second raised portion 6066 is formed at the reverse side of the valve body portion 6005 that faces the opening 90 at the time of closing the opening 90, straddling the boundary between the valve main portion 6050 and the flange 6060.

The second raised portion 6066 is positioned at the reverse side of the valve body portion 6005 so as to be able to contact the first raised portion 6046 at the time of valve-closing and protrudes at the reverse side of the valve body portion 6005. In addition, the second raised portion 6066 is formed with an inclined surface 6067 at an area that abuts on the first raised portion 6046. The inclined surface 6067 becomes a surface that extends along the inclined surface 6047 of the first raised portion 6046 at the time of abutment.

As well as the first embodiment, second bent portions 6062 of the flange 6060 have holes 6069 through which a support shaft 6044 extends. With the support shaft 6044 extending through the holes 6069, the valve body portion 6005 is mounted rotatably relative to the fixing portion 6003. The coil spring 7 wound around the support shaft 6044 biases the valve body portion 6005 in the valve-closing direction that the valve main portion 6050 closes the opening 90.

As illustrated in FIGS. 5A and 5B, the changeover valve 6001 (see FIG. 4A) has the fixing portion 6003 that rotatably fixes the valve body portion 6005 (FIG. 4A).

The fixing portion 6003 has a pair of legs 6036 and a bridge 6037 laid between the pair of legs 6036. Each of the pair of legs 6036 has a bottom edge at the side of the exhaust pipe 9 that is bent outwardly (towards the other leg 6036 viewed from the one leg 6036) to form a bent portion 6038. The bent portions 6038 are welded onto the exhaust pipe 9.

Figure 4D:
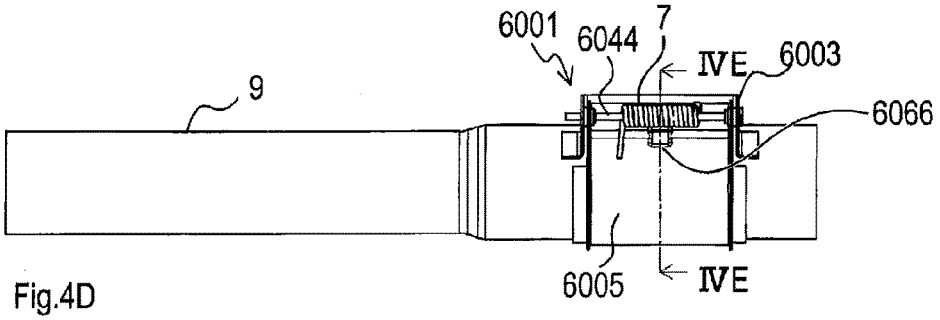
FIG. 4D is a front view of the exhaust pipe attached with the changeover valve of the sixth embodiment.
Figure 4E:
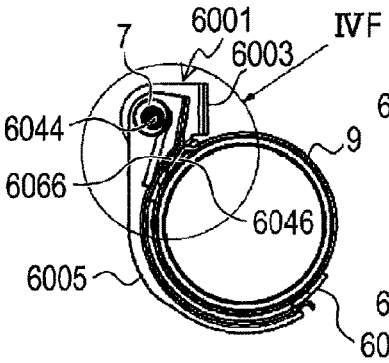
FIG. 4E is a cross-sectional view taken along line IVE-IVE of FIG. 4D.
Figure 4F:
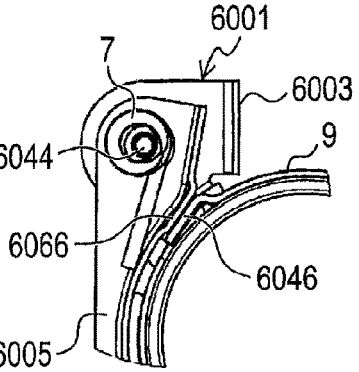
FIG. 4F is an enlarged view of a portion illustrated with a sign IVF in FIG. 4E.
Figure 4G:
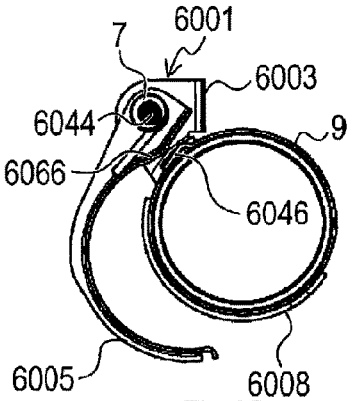
FIG. 4G is a cross-sectional view of the exhaust pipe cut along line IVE-IVE in FIG. 4D, illustrating an opening opened by a valve body portion.

As illustrated in FIG. 4D, the support shaft 6044 to fix the coil spring 7 is attached between the pair of legs 6036 configuring the fixing portion 6003.

The coil spring 7 elastically deforms with the bridge 6037 of the fixing portion 6003 as a fulcrum and biases the valve body portion 6005 in the valve-closing direction.

The changeover valve 6001 configured as described above realizes the following effects in addition to realizing the similar characteristic effects as the changeover valve 1 of the first embodiment.

The changeover valve 1 of the first embodiment is employed in a manner of being mounted at one end of the exhaust pipe. It thus needs a space at the side of the one end of the exhaust pipe so that the valve body portion 5 functions to open and close. However, the changeover valve 6001 of the sixth embodiment does not need this space.

Because the exhaust pipe is of long shape, there is often less space at the side of an end of an exhaust pipe. The changeover valve 6001 of the sixth embodiment does not use the above mentioned space, so that the changeover valve 6001 is able to be employed for an exhaust pipe with no space at the side of the end of the exhaust pipe.

[Embodiment 7]

Described below is a seventh embodiment of the present disclosure as an example with reference to the drawings. However, only differences of the seventh embodiment from the sixth embodiment are described below.

Figure 6A:
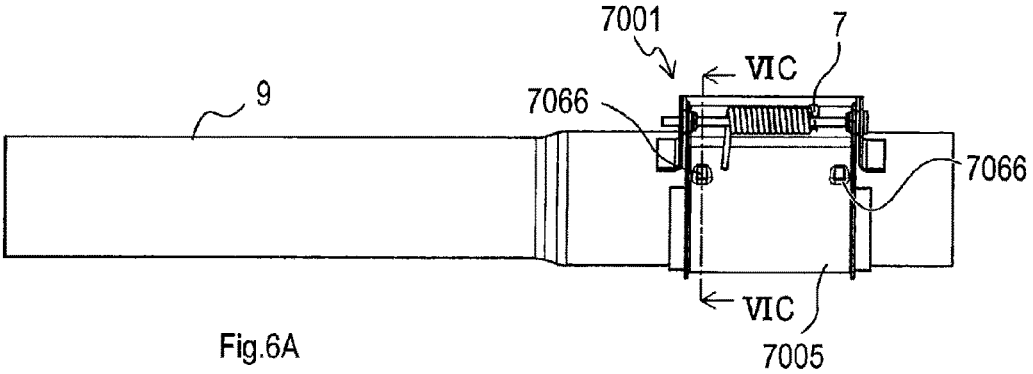
FIG. 6A is a front view of an exhaust pipe mounted with a changeover valve of a seventh embodiment.
Figure 6B:
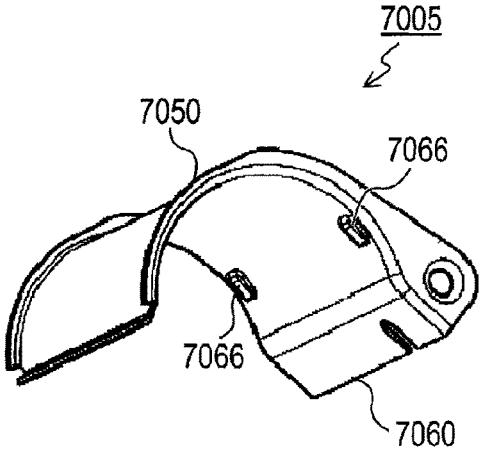
FIG. 6B is a perspective view of a valve body portion configuring the changeover valve of the seventh embodiment.
Figure 6C:
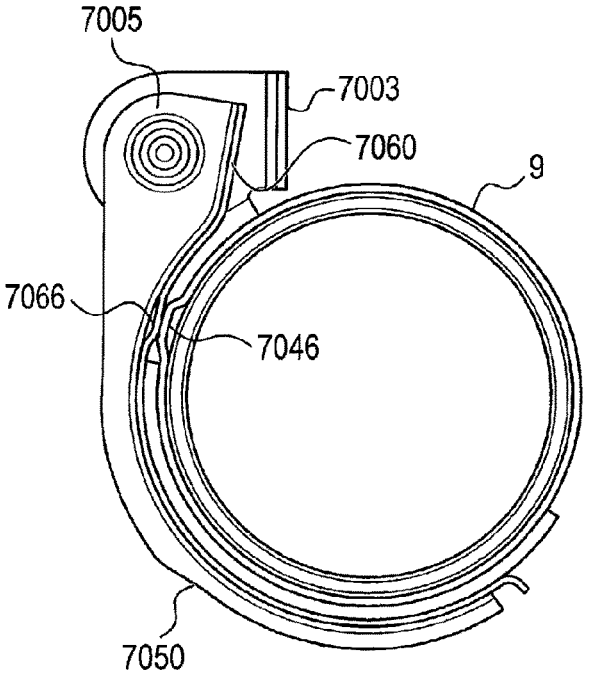
FIG. 6C is a cross-sectional view taken along line VIC-VIC of FIG. 6A.

As illustrated in FIGS. 6A and 6B, the changeover valve 7001 of the seventh embodiment is different from the changeover valve 6001 of the sixth embodiment in that two second raised portions 7066 are formed being positioned away from the boundary between a valve main portion 7050 and a flange 7060. These second raised portions 7066 are formed being positioned at an area where the second raised portions 7066 abut on the exhaust pipe 9 when the valve body portion 7005 closes the opening 90 and at both sides of the opening 90 (both sides in the axial direction of the exhaust pipe 9 viewed from the opening 90). Therefore, as illustrated in FIG. 6C, two first raised portions 7046 are formed at an abutment position of the exhaust pipe 9 where the second raised portions 7066 abut when the valve main portion 7050 closes the opening 90.

[Embodiment 8]

Described below is an eighth embodiment of the present disclosure as an example with reference to the drawings. However, only differences of the eighth embodiment from the sixth embodiment are described below.

As illustrated in FIGS. 7A to 7D, a changeover valve 8001 of the eighth embodiment is different from the changeover valve 6001 of the sixth embodiment only regarding the positions of first raised portions 8046 and second raised portions 8066, and the other configuration of the changeover valve 8001 is the same as the one of the changeover valve 6001 of the sixth embodiment.

Figure 7A:
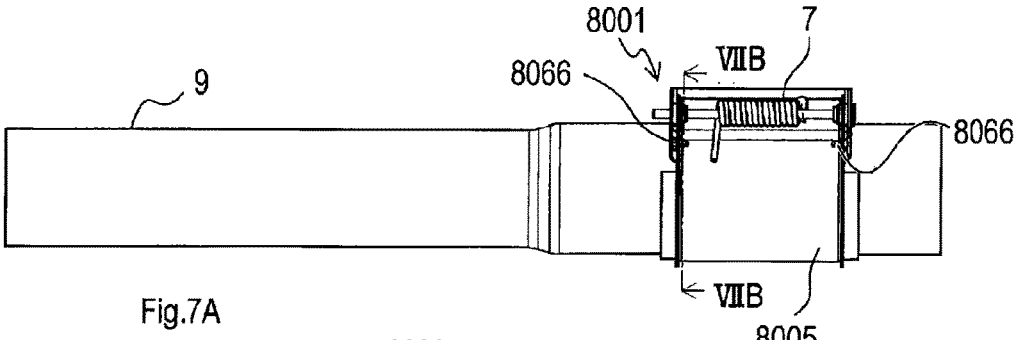
FIG. 7A is a front view of an exhaust pipe mounted with a changeover valve of an eighth embodiment.
Figure 7B:
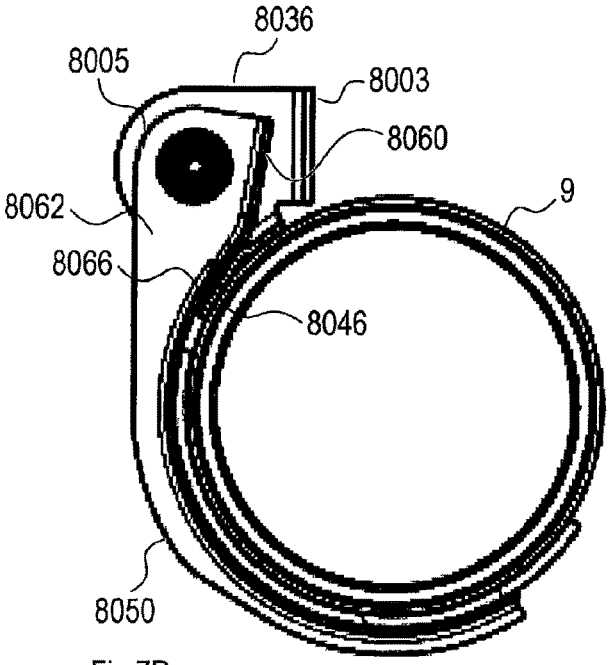
FIG. 7B is a cross-sectional view taken along line VIIB-VIIB of FIG. 7A.
Figure 7C:
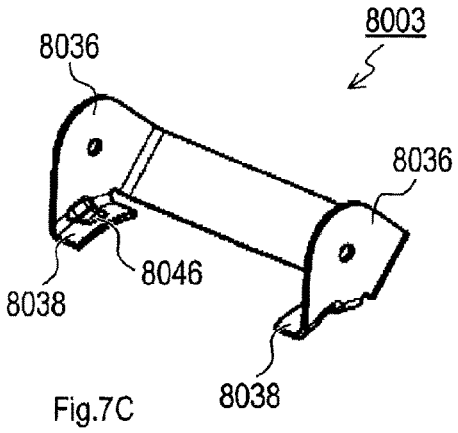
FIG. 7C is a perspective view of a fixing portion configuring the changeover valve of the eighth embodiment.

As illustrated in FIG. 7C, the changeover valve 8001 of the eighth embodiment has bent portions 8038 which are formed by bending inwardly (towards the other leg 8036 viewed from the one leg 8036) bottom edges of legs 8036 configuring a fixing portion 8003. The fixing portion 8003 is welded onto the exhaust pipe 9 via the bent portions 8038.

Figure 7D:
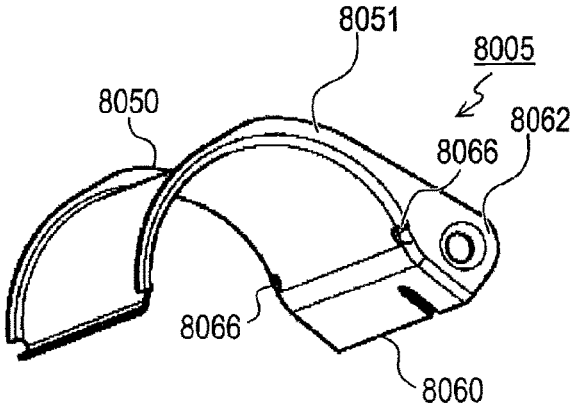
FIG. 7D is a perspective view of a valve body portion configuring the changeover valve of the eighth embodiment.

Further, as illustrated in FIG. 7D, both ends in the width direction of a valve main portion 8050 are bent vertically relative to the valve main portion 8050 and a flange 8060. The bent portions of the flange 8060 out of all the bent portions configure second bent portions 8062.

First raised portions 8046 are formed on the bent portions 8038 of the legs 8036.

Second raised portions 8066 are formed at the reverse surface of the valve main portion 8050, in the vicinity of the boundary between the valve main portion 8050 and the flange 8060, and at the boundary with bent portions 8051 at both ends in the width direction of the valve main portion 8050.

In the changeover valve 6001 of the sixth embodiment, the first raised portion 6046 is provided on the exhaust pipe 9, so that there is need to process the exhaust pipe 9. However, in the changeover valve 8001 of the eighth embodiment, the first raised portions 8046 are formed on the fixing portion 8003, so that there is no need to process the exhaust pipe 9.

As a result, the changeover valve 8001 of the eighth embodiment can be mounted on the exhaust pipe 9 only by attaching the cushion portion 6008 to the exhaust pipe 9 and welding the fixing portion 8003 to the exhaust pipe 9.

In addition, in the changeover valve 8001 of the eighth embodiment, the first raised portions 8046 are provided at the fixing portion 8003, and the second raised portions 8066 are provided at the valve body portion 8005 rotatably fixed to the fixing portion 8003. Therefore, the changeover valve 8001 of the eight embodiment can be mounted on the exhaust pipe 9 without adjusting attachment positions of the first raised portions 8046 and the second raised portions 8066.

[Other Embodiments]

The invention described within the scope of claims is not limited to the above described embodiments and can be achieved by many other embodiments.

(1) The cushion portion 8 of the above embodiments is made of stainless mesh, but it is not limited hereto.

(2) According to the fourth embodiment, it is described that the shape of the first raised portions 4046 along the flat surface of the flange 40 is in the inverse V shape. However, the projected shape of the first raised portion 4046 may be the inverse V shape. The inverse V shape referred to herein is a shape that the projected shape along a surface vertical relative to the direction in which the second raised portion 66 is directed towards the first raised portions 4046 is along the two sides of a triangle. Further, what the projected shape being the inverse V shape means is not only that the shape of "the surface along the flat surface of the flange 40" being "the vertical surface" relative to the direction in which the first raised portions 4046 is directed towards the second raised portion 66 is in the inverse V shape, but also that the shape of "the surface inclined relative to the surface along the flat surface of the flange 40" is in the inverse V shape.

(3) In the above described embodiments, the contact is made at two points at most, for example. However, the contact may be made at three or more points.

[Corresponding Relation] Described below are the configurations of the above-described embodiments and the corresponding relation to the configuration of the present disclosure.

The coil spring 7 of the embodiment corresponds to an example of a biasing portion of the present disclosure.

The exhaust pipe 9 of the embodiment corresponds to an example of a flow path forming portion of the present disclosure.

The invention claimed is:

1. A changeover valve that switches an exhaust flow path of an internal combustion engine, the changeover valve comprising:

a valve body portion that closes an opening by covering the opening and a periphery of the opening, the opening being formed at a switching position of the exhaust flow path and at one of a flow path forming portion forming the exhaust flow path or a fixing portion fixed to the flow path forming portion;

the fixing portion that fixes the valve body portion so that the valve body portion rotates between a position to open the opening and a position to close the opening;

a first raised portion raised from one of the flow path forming portion or the fixing portion within an opposing area where one of the flow path forming portion or the fixing portion faces the valve body portion at a time of valve closing when the valve body portion closes the opening;

a cushion portion arranged at the periphery of the opening at a position including at least the opposing area;

a second raised portion raised from the valve body portion and formed at a position where the second raised portion is arranged to contact the first raised portion at the time of valve closing; and a biasing portion that biases the valve body portion in a valve closing direction in which the valve body portion closes the opening, wherein the first raised portion has a first inclined portion inclined relative to the valve closing direction, the second raised portion has a second inclined portion inclined relative to the valve closing direction, and the first inclined portion of the first raised portion is arranged to contact the second inclined portion of the second raised portion at the time of valve closing;

wherein the valve body portion is formed in a shape along a side surface of an exhaust pipe forming the flow path forming portion and rotatably fixed to the fixing portion to close the opening; and wherein the opening is formed at the side surface of the exhaust pipe, and the cushion portion is arranged at the periphery of the opening formed at the exhaust pipe.

2. The changeover valve according to claim 1, wherein the fixing portion comprises a pair of legs arranged away from each other at a certain distance, the pair of legs having bent portions formed by inwardly bending an end of each leg of the pair of legs, the fixing portion is fixed to the flow path forming portion by welding the bent portions on the flow path forming portion, and the first raised portion is formed at each of the bent portions forming the pair of legs.

3. The changeover valve according to claim 1, wherein the fixing portion comprises an insert portion and a valve seat portion both formed in a cylindrical shape, the insert portion is formed to be coaxially insertable in an exhaust pipe forming the flow path forming portion and forms the opening, the valve seat portion is formed to be radially expanded away from the insert portion, the valve body portion includes a valve seat opposed portion formed at a position where the valve body portion faces the valve seat portion at the time of valve closing and is radially contracted in the valve closing direction to close the opening, and the cushion portion is arranged at the valve seat portion.

4. The changeover valve according to claim 1, wherein the first inclined portion formed at the first raised portion and the second inclined portion formed at the second raised portion are formed in a manner of making a point contact, a line contact, or a surface contact at a time of contact.

5. The changeover valve according to claim 1, wherein the first raised portion and the second raised portion are formed to contact each other at multiple points.

6. The changeover valve according to claim 5, wherein a projected shape along a surface vertical relative to a direction in which the second raised portion is directed towards the first raised portion at the time of valve closing is formed along two sides of a triangle, and the second raised portion contacts an area corresponding to each side of the first raised portion.

7. The changeover valve according to claim 1, wherein the first raised portion and the second raised portion contact each other at a position that is closer to a position where the valve body portion is supported so as to be rotatable relative to the fixing portion than a position where the biasing portion biases the valve body portion.

8. The changeover valve according to claim 1, wherein the cushion portion has a thickness so that the first raised portion and the second raised portion face each other at a predetermined distance therebetween when the cushion portion is held between the valve body portion and one of the flow path forming portion or the fixing portion at the time of valve closing.

9. A changeover valve that switches an exhaust flow path of an internal combustion engine, the changeover valve comprising:

a valve body portion that closes an opening by covering the opening and a periphery of the opening, the opening being formed at a switching position of the exhaust flow path and at one of a flow path forming portion forming the exhaust flow path or a fixing portion fixed to the flow path forming portion;

the fixing portion that fixes the valve body portion so that the valve body portion rotates between a position to open the opening and a position to close the opening;

a first raised portion raised from one of the flow path forming portion or the fixing portion within an opposing area where one of the flow path forming portion or the fixing portion faces the valve body portion at a time of valve closing when the valve body portion closes the opening;

a cushion portion arranged at the periphery of the opening at a position including at least the opposing area;

a second raised portion raised from the valve body portion and formed at a position where the second raised portion is arranged to contact the first raised portion at the time of valve closing; and a biasing portion that biases the valve body portion in a valve closing direction in which the valve body portion closes the opening;

wherein the first raised portion has a first inclined portion inclined relative to the valve closing direction, the second raised portion has a second inclined portion inclined relative to the valve closing direction, and the first inclined portion of the first raised portion is arranged to contact the second inclined portion of the second raised portion at the time of valve closing;

wherein the first raised portion and the second raised portion are formed to contact each other at multiple points; and wherein a projected shape along a surface vertical relative to a direction in which the second raised portion is directed towards the first raised portion at the time of valve closing is formed along two sides of a triangle, and the second raised portion contacts an area corresponding to each side of the first raised portion.

* * * * *